US011112211B1

(12) United States Patent
Watson

(10) Patent No.: US 11,112,211 B1
(45) Date of Patent: Sep. 7, 2021

(54) DUAL COMPARTMENT GUN HOLSTER

(71) Applicant: Scott Lessley Watson, Cape Girardeau, MO (US)

(72) Inventor: Scott Lessley Watson, Cape Girardeau, MO (US)

( * ) Notice: Subject to any disclaimer, the term of this patent is extended or adjusted under 35 U.S.C. 154(b) by 0 days.

(21) Appl. No.: 16/450,668

(22) Filed: Jun. 24, 2019

Related U.S. Application Data

(60) Provisional application No. 62/689,342, filed on Jun. 25, 2018.

(51) Int. Cl.
*F41C 33/02* (2006.01)
*F41C 33/06* (2006.01)
*A45F 3/00* (2006.01)

(52) U.S. Cl.
CPC ..... *F41C 33/0218* (2013.01); *A45F 3/005* (2013.01); *F41C 33/06* (2013.01); *A45F 2200/0516* (2013.01); *A45F 2200/0591* (2013.01)

(58) Field of Classification Search
CPC F41C 33/048; F41C 33/0218; F41C 33/0209; A45F 2200/0591; Y10S 224/911
See application file for complete search history.

(56) References Cited

U.S. PATENT DOCUMENTS 3,001,566 A * 9/1961 Lipsitz ..... A45C 3/00 224/610
3,347,299 A 10/1967 Alexander
3,688,315 A 9/1972 Oliver
4,966,320 A * 10/1990 DeSantis ..... A45C 1/04 224/192
5,197,525 A * 3/1993 Cantor ..... A45C 1/00 150/102
5,277,361 A 1/1994 Stude
5,294,031 A * 3/1994 Volpei ..... A45F 3/00 224/192
5,409,153 A * 4/1995 Ristich ..... A45C 1/04 150/112
5,584,424 A * 12/1996 Stava ..... A45F 3/00 224/240
5,829,653 A * 11/1998 Kaiser ..... A45F 4/02 224/577
5,924,565 A 7/1999 Colee
5,967,393 A 10/1999 Clarke, III
6,161,738 A 12/2000 Norris
6,446,688 B1 * 9/2002 Sutton ..... A45C 3/08 150/105
7,806,309 B2 10/2010 Korchmar
8,328,058 B2 12/2012 Wilson
8,622,269 B2 1/2014 Hogue
9,103,627 B1 8/2015 Campbell
9,198,498 B2 12/2015 Stevens, IV
9,265,319 B1 2/2016 Zeh-Franke
9,476,675 B1 * 10/2016 Manglos ..... F42B 39/02
(Continued)

*Primary Examiner* — Brian D Nash
(74) *Attorney, Agent, or Firm* — Polsinelli PC

(57) ABSTRACT

A dual compartment gun holster is described. The holster includes a first compartment for holding a personal electronic device and a second compartment for holding a gun. The gun is held to an extending piece or a member that extends and retracts into the second compartment. The first compartment is formed on an exterior side of the gun holster, and thus the dual compartment gun holster appears to be an ordinary cell phone case.

20 Claims, 10 Drawing Sheets

(56) References Cited

U.S. PATENT DOCUMENTS

| | | | | |
|---|---|---|---|---|
| 9,500,440 | B2 | 11/2016 | Gordon et al. | |
| 9,772,162 | B2 | 9/2017 | Manglos | |
| 9,803,956 | B2 | 10/2017 | Ellingson | |
| 9,891,021 | B2 * | 2/2018 | Galoob | F41C 33/0236 |
| 10,018,448 | B2 * | 7/2018 | Klymenko | F41C 33/048 |
| 10,247,514 | B2 * | 4/2019 | Chambers | F41C 33/0218 |
| 2004/0217141 | A1 | 11/2004 | Brooks | |
| 2007/0000965 | A1 * | 1/2007 | Cannon, Jr. | F41C 33/06 224/673 |
| 2007/0170219 | A1 * | 7/2007 | Ballarta | A45F 3/04 224/645 |
| 2012/0190413 | A1 * | 7/2012 | Ojeda | A45F 5/021 455/575.8 |
| 2013/0015225 | A1 * | 1/2013 | Hogue | F41C 33/0272 224/587 |
| 2014/0027479 | A1 * | 1/2014 | Hogue | F41C 33/029 224/183 |
| 2015/0237998 | A1 * | 8/2015 | Stevens, IV | F41C 33/0209 224/660 |
| 2016/0123700 | A1 * | 5/2016 | Manglos | F41C 33/048 150/112 |
| 2017/0292810 | A1 | 10/2017 | Thompson | |
| 2018/0055173 | A1 | 3/2018 | Hatch et al. | |

* cited by examiner

FIG. 1
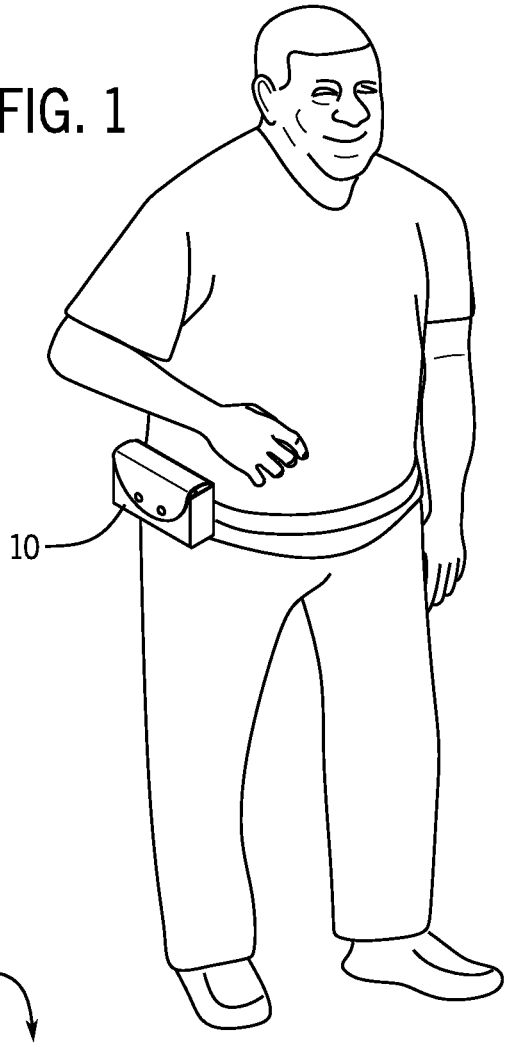
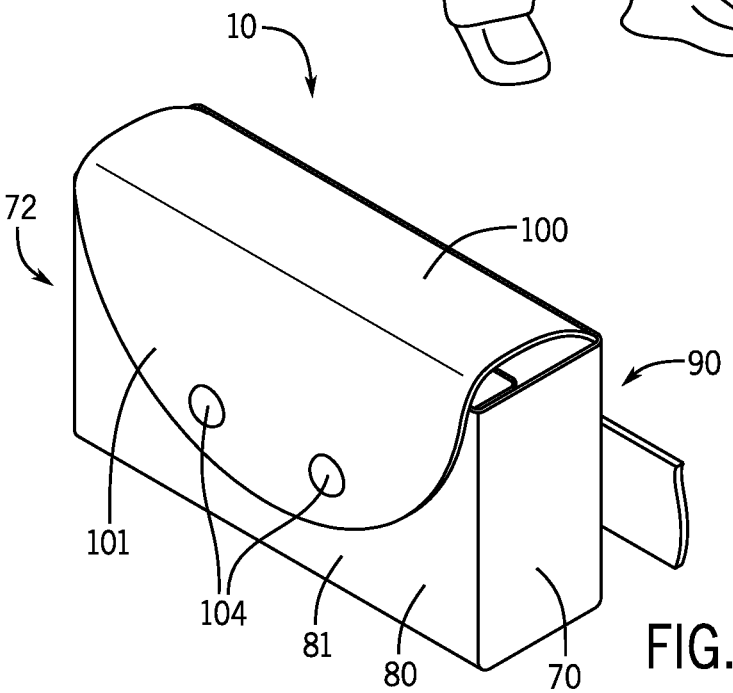
FIG. 2

DUAL COMPARTMENT GUN HOLSTER

This application claims priority to U.S. Provisional Application No. 62/689,342 filed Jun. 25, 2018.

FIELD OF INVENTION

The present invention relates to a dual compartment gun holster.

SUMMARY

A dual compartment gun holster is described. The gun holster includes a first compartment for holding a personal electronic device, such as a cell phone, and a second compartment for holding a gun. A flap covers the first compartment and the second compartment. The flap includes an extending piece that extends from an interior of the second compartment. The gun is removably held to the flap and/or the extending piece. In order to draw the gun from the holster, the user pulls up on the flap which withdraws the gun and the extending piece from the interior of the second compartment.

The first compartment is formed on an exterior side of the gun holster, and thus the dual compartment gun holster appears to be an ordinary cell phone case. Even when the cell phone is removed from the first compartment, the gun is still concealed in the second compartment.

In one aspect, a dual compartment gun holster is described. The holster includes a first compartment defining a first interior and a first opening. The holster includes a second compartment defining a second interior and a second opening. A flap is configured to cover the first opening and the second opening. The flap has an extending piece that is affixed to the second interior. The extending piece includes a holding member to hold a gun. When the user wants to draw the gun, the user pulls up on the flap which pulls the extending piece (with the gun) from the second interior of the second compartment of the holster.

In another aspect, a dual compartment gun holster is described. The holster includes a front wall and a rear wall connecting or joining with end walls. A central wall is positioned between the front wall and the rear wall to form a first compartment and a second compartment. The first compartment defines a first interior and a first opening. The second compartment defines a second interior and a second opening. A flap is configured to cover the first opening and the second opening. The flap has an extending piece that is affixed to the second interior. The extending piece includes a holding member to hold a gun.

In another aspect, a dual compartment gun holster is described. The holster includes a first compartment that defines a first interior and a first opening. The holster includes a second compartment that defines a second interior and a second opening. A flap is configured to cover the first opening and the second opening. The flap has an extending piece that is affixed to the second interior. The extending piece includes a holding member configured to hold a gun. The first compartment is configured to hold a personal electronic device. The second compartment is configured to hold the gun. The extending piece is attached to the second compartment. The extending piece is configured to extend from the second compartment and retract into the second compartment.

In another aspect, a dual compartment gun holster is described. The holster includes a front wall and a rear wall that connect or join with end walls. A central wall is positioned between the front wall and the rear wall to form a first compartment and a second compartment. The first compartment defines a first interior and a first opening. The second compartment defines a second interior and a second opening. A flap is configured to cover the first opening and the second opening and extend over a portion of the front wall. The flap includes an extending piece that is affixed to the second interior. The extending piece includes a holding member configured to hold a gun. The first compartment is configured to hold a personal electronic device. The second compartment is configured to hold the gun. The extending piece is configured to extend from the second compartment to an extended position and retract into the second compartment to a retracted position. In the extended position, the holding member is fully removed from the second compartment.

BRIEF DESCRIPTION OF DRAWINGS

FIG. 1 is a view of an individual using the dual compartment gun holster.

FIG. 2 is a perspective view of the dual compartment gun holster.

DETAILED DESCRIPTION OF INVENTION

Figure 3:
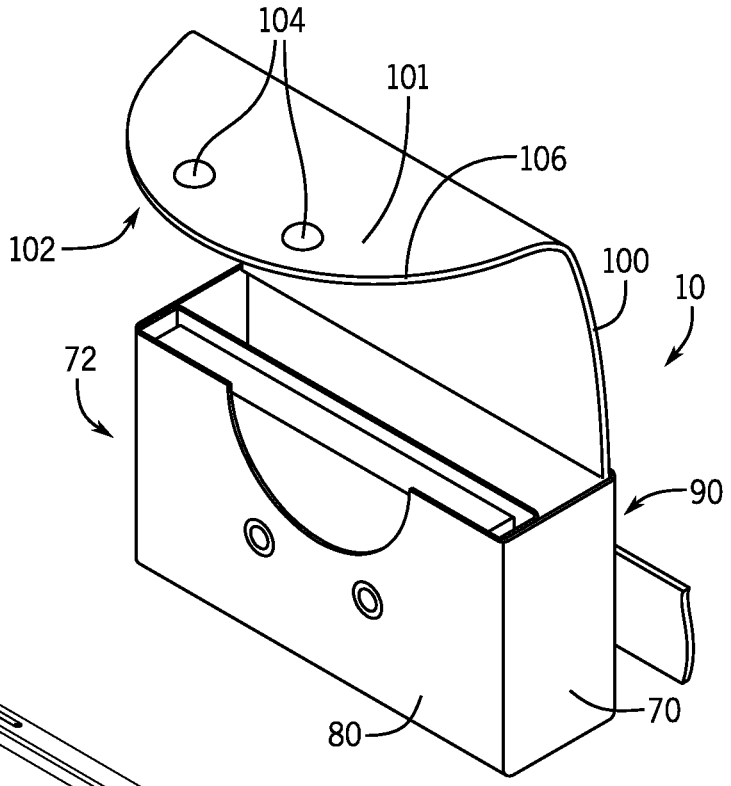
FIG. 3 is a view of the dual compartment gun holster with the flap in an open position.
Figure 4:
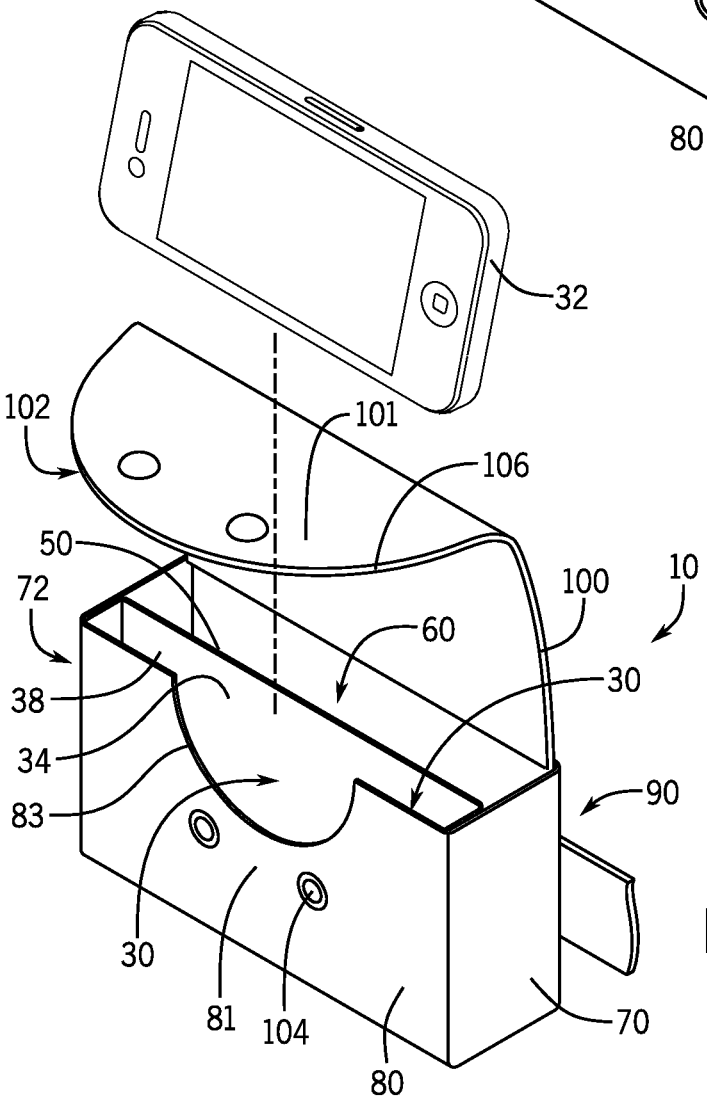
FIG. 4 is a view of the dual compartment gun holster with the flap in an open position with a cell phone removed from the first compartment.
Figure 5:
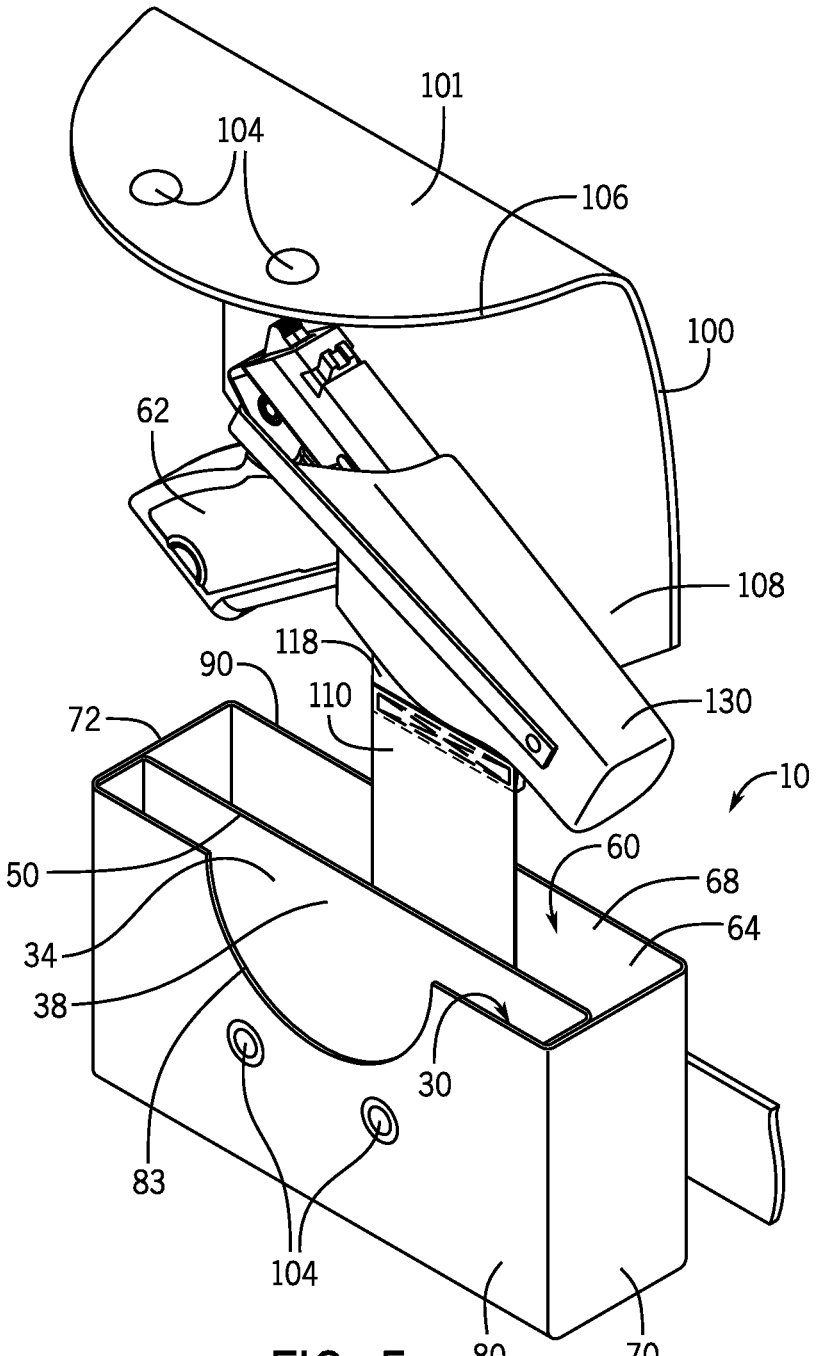
FIG. 5 is a view of the dual compartment gun holster with the extending piece holding a gun and extended from the second compartment.
Figure 6:
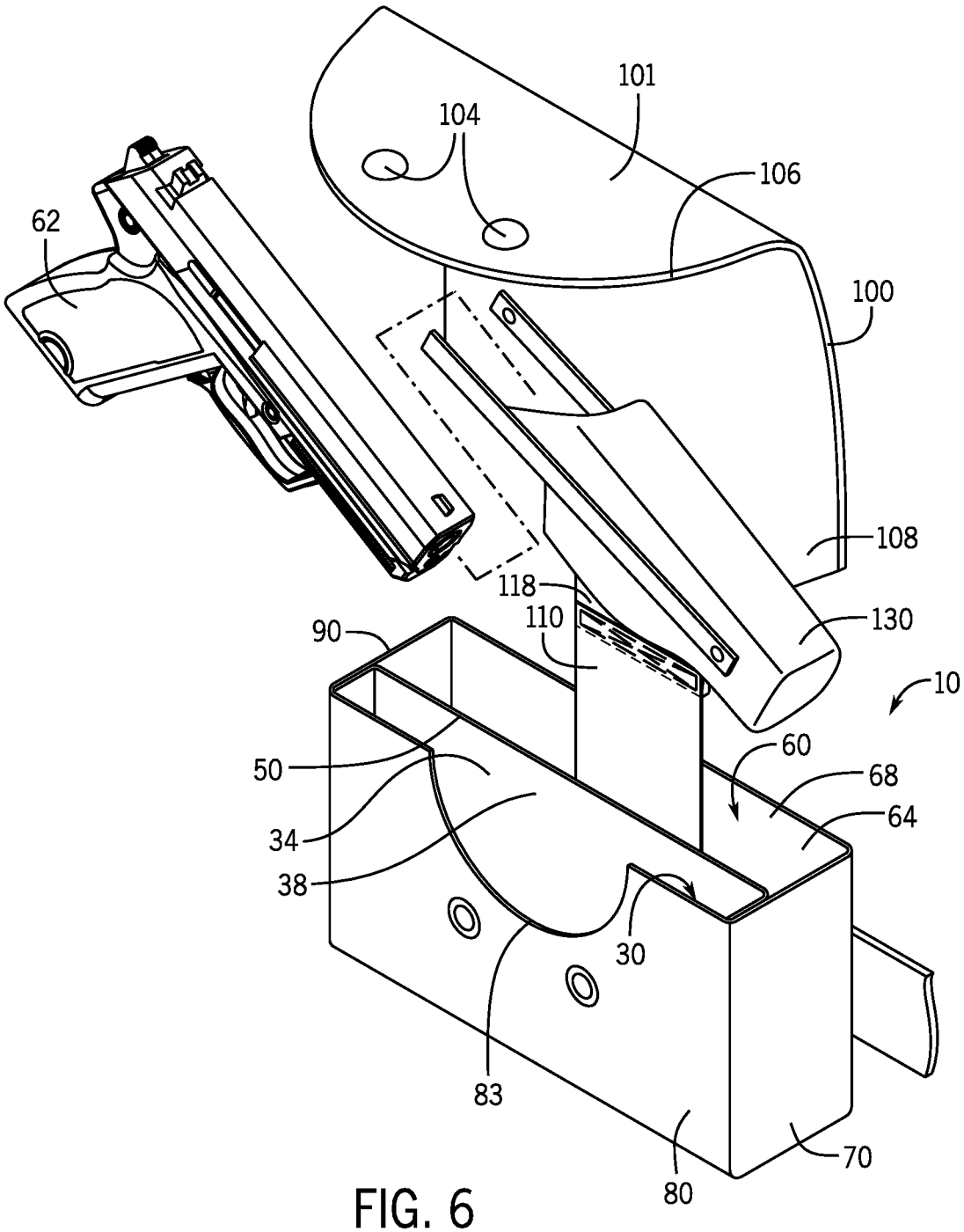
FIG. 6 is a view of the dual compartment gun holster with the extending piece extended from the second compartment and the gun removed from the extending piece.
Figure 7:
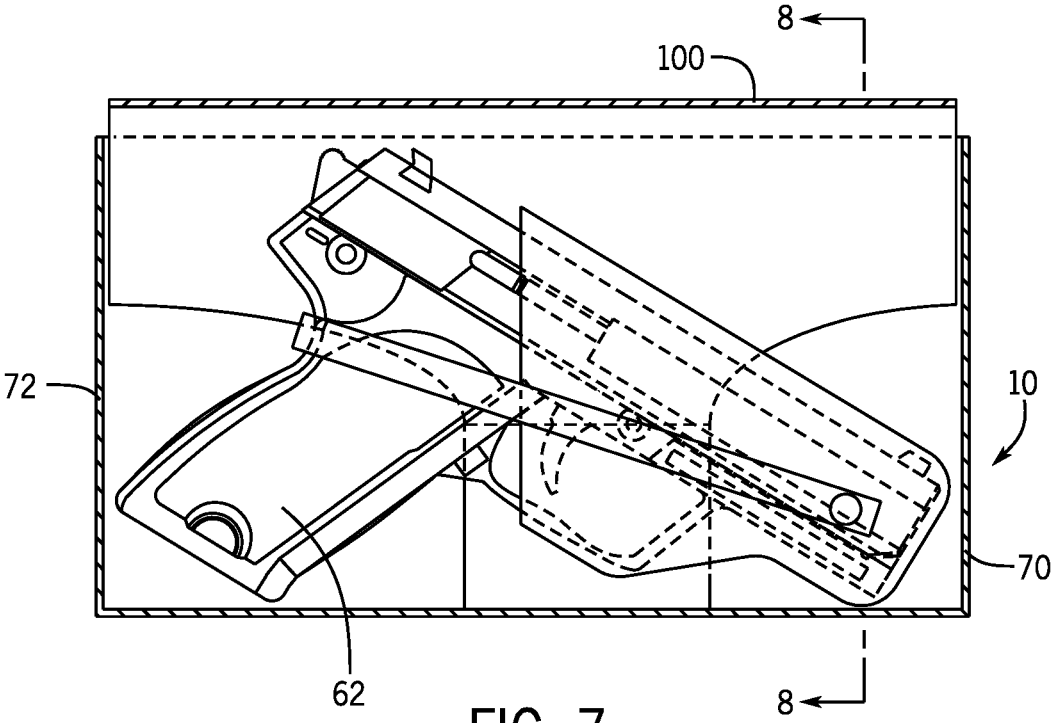
FIG. 7 is a front sectional view of the dual compartment gun holster with the gun in the second compartment.
Figure 8:
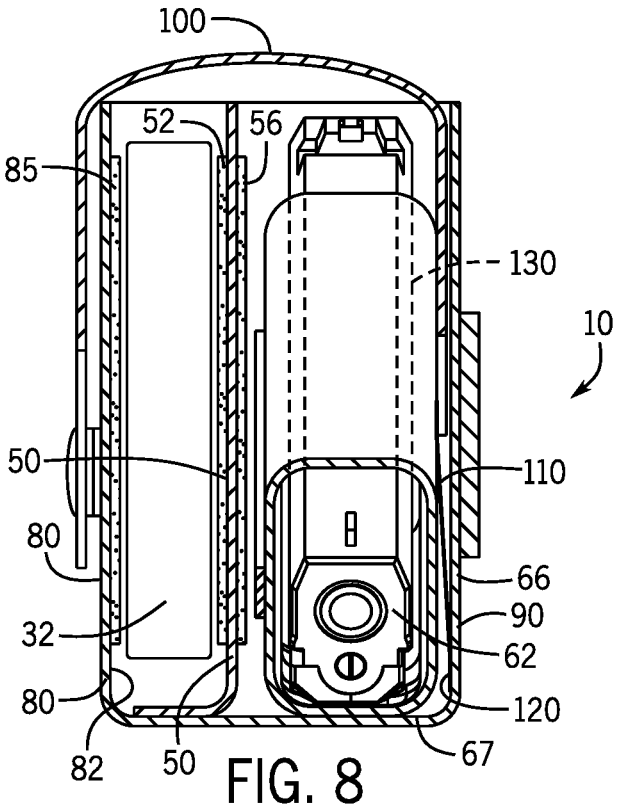
FIG. 8 is an end sectional view of the dual compartment gun holster with the phone in first compartment and the gun in the second compartment.

A dual compartment gun holster 10 will now be described with reference to FIGS. 1-10. For purposes of this application, any terms that describe relative position (e.g., "upper", "middle", "lower", "outer", "inner", "above", "below", "bottom", "top", etc.) refer to an embodiment of the invention as illustrated, but those terms do not limit the orientation in which the embodiments can be used.

The holster 10 includes a first compartment 30 for holding a personal electronic device 32 and a second compartment 60 for holding a gun 62. A flap 100 covers the first compartment 30 and the second compartment 60. The flap 100 is made from flexible or bendable material such that the flap 100 flexes or bends over the first compartment 30 and the second compartment 60. The flap 100 is integral with, connects with, or is attached to an extending piece 110 that extends from an interior 64 of the second compartment 60. The flap 100 and the extending piece 110 may be formed as a single member. An end 120 or bottom portion of the extending piece 110 is fixed or attached to the interior 64 of the second compartment 60. The end 120 is on an opposite side of the extending piece 110 as the flap 100. The gun 62 is removably held to the extending piece 110 by a holding member 130, such as a clip, hook and loop fastener, straps, snaps, etc.

The first compartment 30 for holding the personal electronic device 32 includes an interior 34. The first compartment 30 further includes an opening 38 leading to the interior 34. The second compartment 60 for holding the gun 62 includes the interior 64. The second compartment 60 further includes an opening 68 leading to the interior 64. When the holster 10 is worn by the user, the second compartment 60 is between the user's body and the first compartment 30. This arrangement helps to conceal the fact that the second compartment 60 is part of the holster 10.

A front wall 80 and a rear wall 90 connect or join with end walls 70 and 72 of to form the holster 10. The flap 100 extends over a portion of the front wall 80. A bottom wall may connect or join with the end walls 70 and 72 and the front wall 80 and rear wall 90. The flap 100 may be held in the closed position with respect to the front wall 80 by one or more snaps 104 on a front side 101 of the flap 100. Corresponding snaps 104 are positioned on an outer surface 81 of the front wall 80. In other aspects, magnets, hook and loop fasteners, etc. may be used to close the flap 100 over the front wall 80.

A central wall 50 is positioned between the front wall 80 and the rear wall 90 to form the first compartment 30 and the second compartment 60. The first compartment 30 and the second compartment 60 are generally on opposite sides of the central wall 50. The central wall 50 is generally parallel to the front wall 80 and the rear wall 90. The central wall 50 may separate the first compartment 30 and the second compartment 60. The central wall 50 may extend the length of the holster 10. The flap 100 may extend over a top of the central wall 50.

Figure 9:
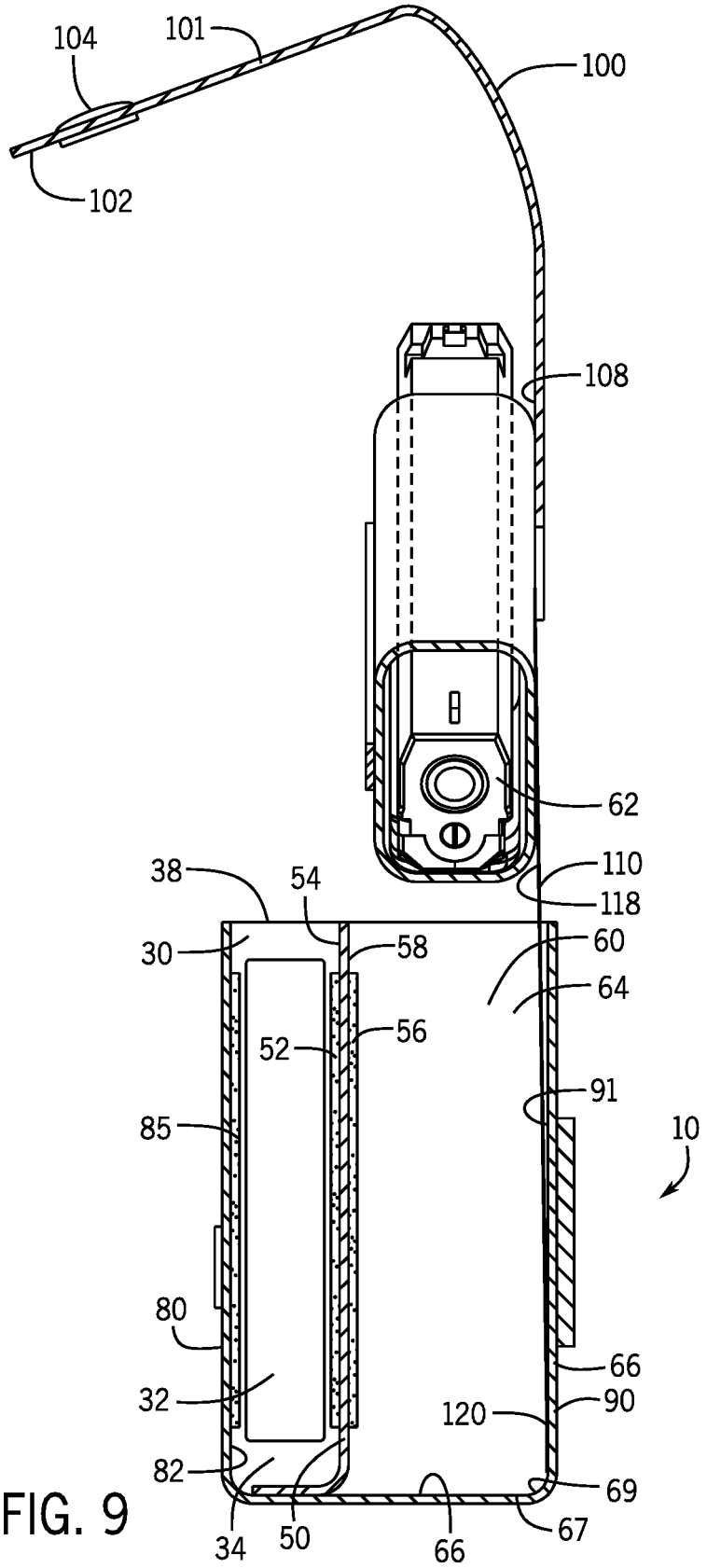
FIG. 9 is an end sectional view of the dual compartment gun holster with the phone in the first compartment with the extending piece extended from the second compartment.

With respect to FIG. 9, the end 120 of the extending piece 110 is fixed or attached to the interior 64 of the second compartment 60. As such, when the user pulls on the flap 100 and withdraws the extending piece 110 from the interior 64 of the second compartment 60, the extending piece 110 still remains connected to the interior 64 of the second compartment 60. For example, a lower portion of a length of the extending piece 110 may be sewn or otherwise attached to an interior surface of the second compartment 60. For example, the extending piece 110 may be sewn or otherwise attached to an interior surface 66 of a bottom wall 67 of the second compartment 60. For example, the extending piece 110 may be sewn or otherwise attached to an interior surface 91 of the rear wall 90. For example, the extending piece 110 may be sewn or otherwise attached to both the interior surface 91 of the rear wall 90 and to the interior surface 66 of the bottom wall 67. The interior surface 91 of the rear wall 90 joins with the interior surface 66 of the bottom wall 67 at a junction 69. The extending piece 110 may also be sewn or otherwise attached to the junction 69.

The flap 100 and the extending piece 110 are generally separate from the rear wall 90 of the holster 10. The flap 100 and the extending piece 110 may be pulled and/or moved independent of the rear wall 90. The extending piece 110 may join or connect with the interior surface 91 of the rear wall 90, but the extending piece may 110 extends relative to the interior surface 91 of the rear wall 90.

When drawing the gun 62 from the second compartment 60, the gun 62 is moved generally upward through the opening 68 with the gun 62 held to a lower portion of the flap 100 and/or the extending piece 110. The extending piece 110 has a length to allow the gun 62 to be fully removed from the second compartment 60 with the gun 62 still held to the flap 100 and/or the extending piece 110. The extending piece 110 may coil or fold over on itself when the extending piece 110 is retracted into the second compartment 60. The extending piece 110 may also be formed from or include a resiliently flexible material that extends and retracts. The extending piece 110 may also be formed from telescoping material that extends and retracts in length. The extending piece 110 may also be formed from spring material that extends and retracts in length under a bias.

The first compartment 30 and the second compartment 60 have generally rectangular shapes. The first compartment 30 is immediately adjacent to the second compartment 60. A long axis of the first compartment 30 is generally parallel to a long axis of the second compartment 60. The opening 38 of the first compartment 30 generally faces upward, i.e., generally perpendicular to the long axis of the first compartment 30. The opening 68 of the second compartment 60 generally faces upward, i.e., generally perpendicular to the long axis of the second compartment 60.

The front wall 80 may include a cut-out 83 to improve access and handling of the flap 100. The cut-out 83 may include a semi-circular, round or other indentation or opening in the front wall 80. The cut-out 83 may make it easier for the user to reach around or under the flap 100 with their fingers and grip a rear side 102 of the flap 100. This allows the user to pull the flap 100 with a closed grip. The flap 100 may include a rounded outer edge 106 that covers the cut-out 83 in the front wall 80 when the flap 100 is in the closed position. The rounded outer edge 106 may improve ergonomics for the flap 100 by making it easier for the user to grab and pull the rounded outer edge 106 when opening the flap 100 to draw the gun 62 or remove the electronic device 32.

With respect to FIG. 9, a padding layer 85 is positioned on an inner surface 82 of the front wall 80. In this aspect, the central wall 50 separates the first compartment 30 and the second compartment 60. A padding layer 52 is positioned on a front surface 54 of the central wall 50. A padding layer 56 is positioned on a rear surface 58 of the central wall 50. The padding layers 85 and 52 help protect the electronic device 32 from scratching and marring. The padding layers 85 and 52 also help to stabilize the electronic device 32 in the first compartment 30. The padding layer 56 helps to protect the gun 62 from scratching and marring. The padding layer 56 also helps to stabilize gun 62 in the second compartment 60.

Figure 10:
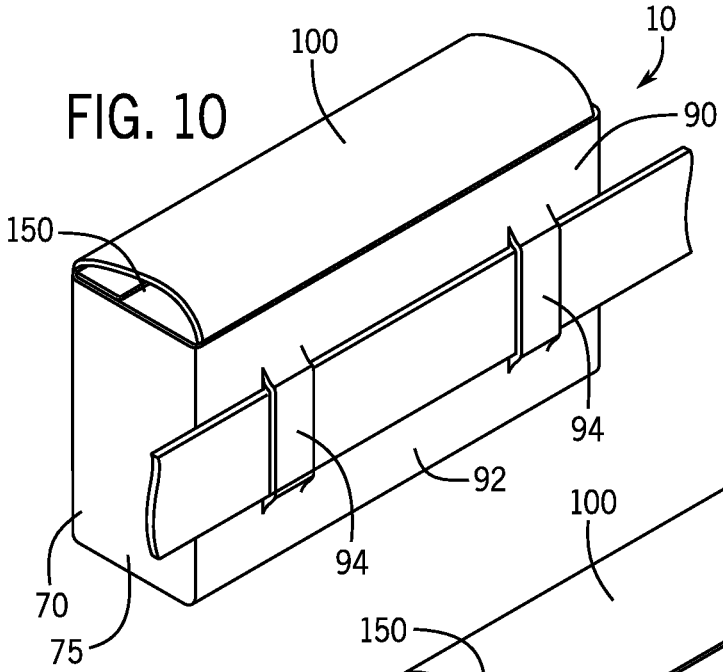
FIG. 10 is a rear perspective of the dual compartment gun holster held to a belt by the belt loops.

An outer surface 92 of a rear wall 90 of the second compartment 60 includes a belt loop, belt clip, pants clip, or other removable engaging member to hold the holster 10 to a belt of the user or to other apparel of the user. In FIG. 10, belts loops 94 are positioned on the outer surface 92.

In order to access the gun 62, the user pulls up on the flap 100 and pulls the flap 100 to pull the extending piece 110 from the second compartment 60. The gun 62 is held to the extending piece 110 or a lower portion of the flap 100 by the holding member 130. The gun 62 is removed from the holding member 130 of the extending piece 110 for use. The extending piece 110 extends from and retracts into the interior 64 of the second compartment 60. The holding member 130 is positioned on an inner surface 108 of the flap 100 and/or on an inner surface 118 of the extending piece 110, i.e., the holding member 130 is positioned adjacent to the central wall 50 when the extending piece 110 is withdrawn or retracted into the second compartment 60. The personal electronic device 32 may include such devices as cell phones, mini-tablets, portable music players, mini-computers, two-way radios, and the like.

The holding member 130 of the extending piece 110 may be provided in a number of different embodiments to accommodate different sizes and types of guns 62. For example, semi-automatic and revolvers may be stored in the holster 10. The gun 62 may be held at a horizontal or at an inclined positioned. The holding member 130 may include a variety of straps, snaps, support members, trigger guards, etc. that are adjustable to hold the particular model of gun 62 and to suit the user's preferences.

Figure 13:
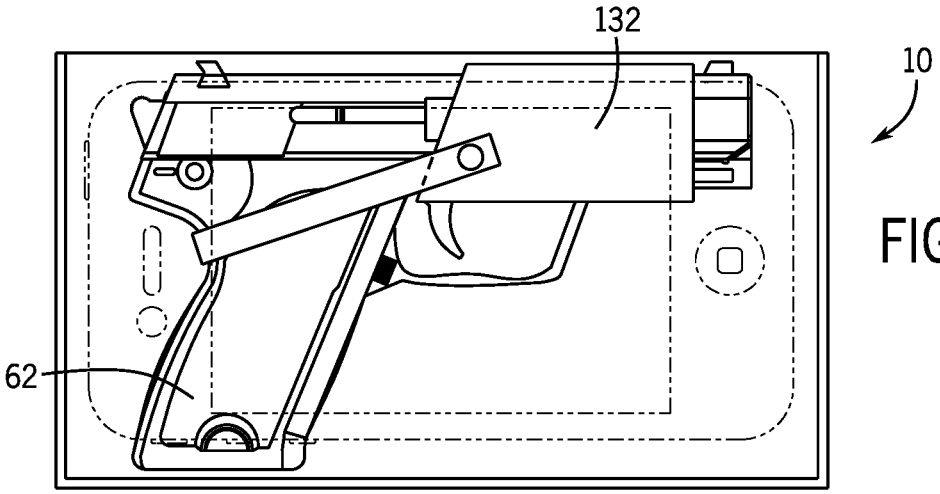
FIG. 13 is a sectional view of the dual compartment gun holster with the gun held to the extending piece by a second holding member.

FIG. 13 is a sectional view of the holster 10 with the gun 62 held to the extending piece 110 by a second holding member 132. The second holding member 132 does not utilize a trigger guard.

Figure 14:
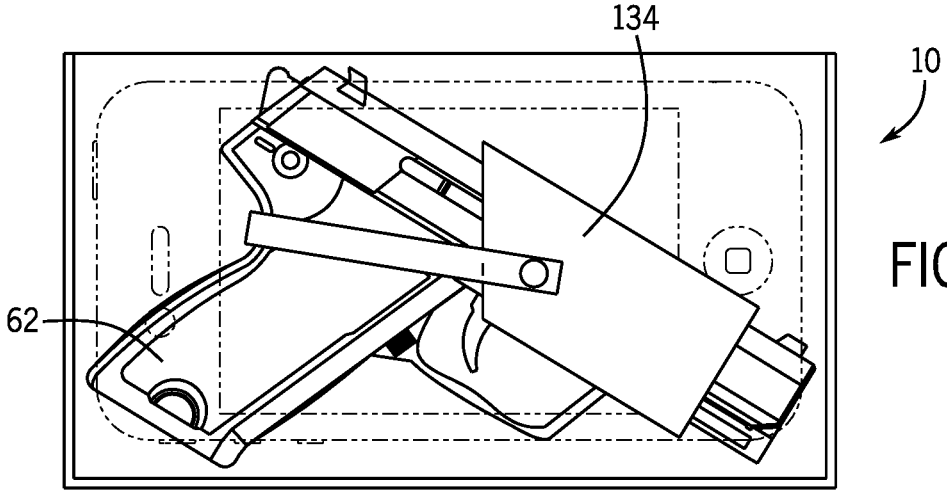
FIG. 14 is a sectional view of the dual compartment gun holster with the gun held to the extending piece by a third holding member.

FIG. 14 is a sectional view of the holster 10 with the gun 62 held to the extending piece 110 by a third holding member 134. The third holding member 134 holds the gun 62 at an incline.

Figure 15:
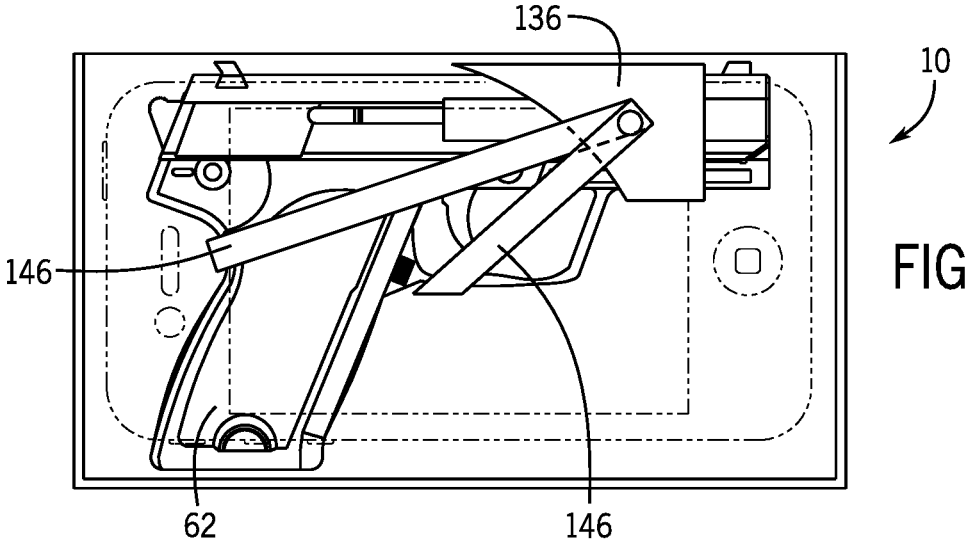
FIG. 15 is a sectional view of the dual compartment gun holster with the gun held to the extending piece by a fourth holding member.

FIG. 15 is a sectional view of the holster 10 with the gun held to the extending piece 110 by a fourth holding member 136. The fourth holding member 136 holds the gun 62 with multiple straps 146 with snap closures.

The holster 10 provides several advantages. First, the holster 10 resembles an ordinary cell phone case. The first compartment 30 for holding the personal electronic device 32 is positioned in front of the second compartment 60 for holding the gun 62. The average observer may not realize that the holster 10 holds the gun 62. Further, even when the user opens the flap 100 to access and remove the personal electronic device 32 from the first compartment 30, the holding member 130 may partially conceal the gun 62 in the second compartment 60. Thus, the holster 10 appears to just be an ordinary cell phone case.

The holster 10 may formed from leather or synthetic materials, such as nylon or other similar materials. The holster 10 may be modified to hold different sized guns 62 and personal electronic devices 32.

The end walls 70 and 72 of the holster 10 connect or join with the front wall 80 and the rear wall 90. The end walls 70 and 72 may be formed or made from the same or different materials as the front wall 80 and the rear wall 90. In certain aspects, the end walls 70 and 72 are formed from a first material and the front wall 80 and the rear wall 90 are formed from a second material. In this aspect, the first material has greater flexibility or stretch than the second material. For example, the first material, forming the end walls 70 and 72, may include a stretchable nylon or other synthetic material that may resiliently stretch and bias. For example, the second material, forming the front wall 80 and the rear wall 90 is leather, vinyl, nylon, other synthetic material, or combinations thereof that is not generally stretchable or resists stretching. In this aspect, when the gun 62 is inserted into the second compartment 60, the end walls 70 and 72 of the holster 10 may stretch or flex to accommodate the gun 62.

Although the first compartment 30 of the holster 10 is described as holding the personal electronic device 32, other personal items, such as wallets, tools, medications, etc. may be stored in the first compartment 30.

Figure 11:
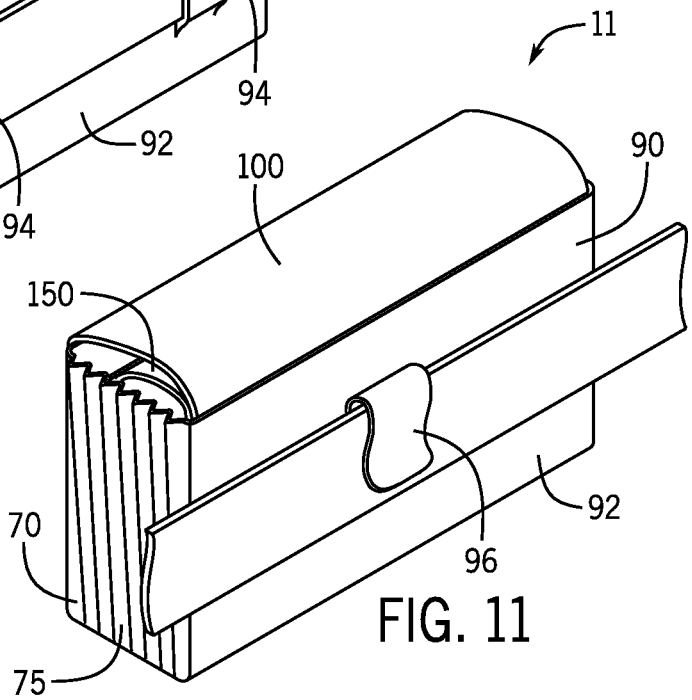
FIG. 11 is a rear perspective of another aspect of the dual compartment gun holster held to the belt by a belt clip.
Figure 12:
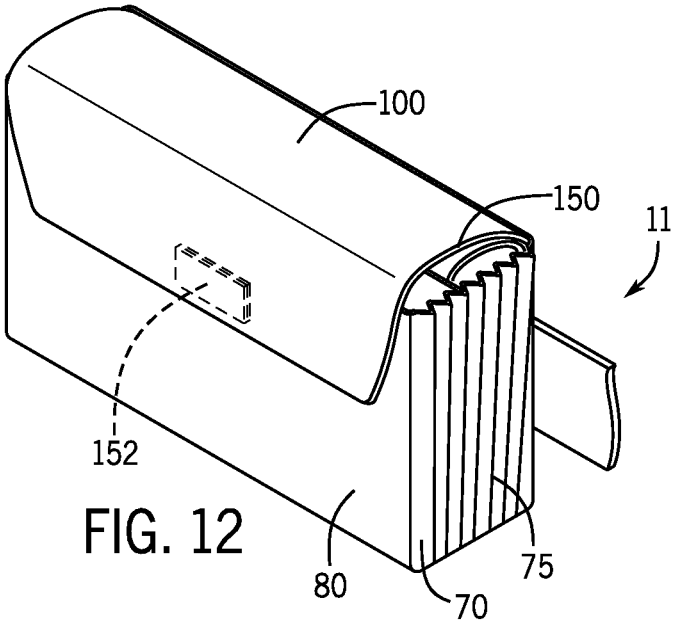
FIG. 12 is a front perspective of another aspect of the dual compartment gun holster using a magnetic closure.

In another aspect, a dual compartment gun holster 11 will now be described with reference to FIGS. 11-12. In this aspect, end walls 70 and 72 of the holster 10 may include a pleated construction, which allows the front wall 80 to fall forward or slightly open when the flap 100 is opened. Pleats 75 are formed in the end walls 70 and 72 to provide for the first compartment 30 and the second compartment 60 to expand. The flap 100 may be held in the closed position with respect to the front wall 80 by a magnetic closure 152 in the flap 100, a snap, hook and loop fasteners, snaps, etc. The front wall 80 may include a complementary magnetic closure that magnetically engages with the magnetic closure 152. In this aspect, a belt clip 96 is positioned on the outer surface 92. The holster 11 includes the same or similar internal construction of the holster 10 including the first compartment 30 for holding the electronic device 32 and the second compartment 60 for holding the gun 62. The extending piece 110 is fixed or attached to the interior 64 of the second compartment 60 of the holster 11 in the same or similar manner as the holster 10.

Figure 16:
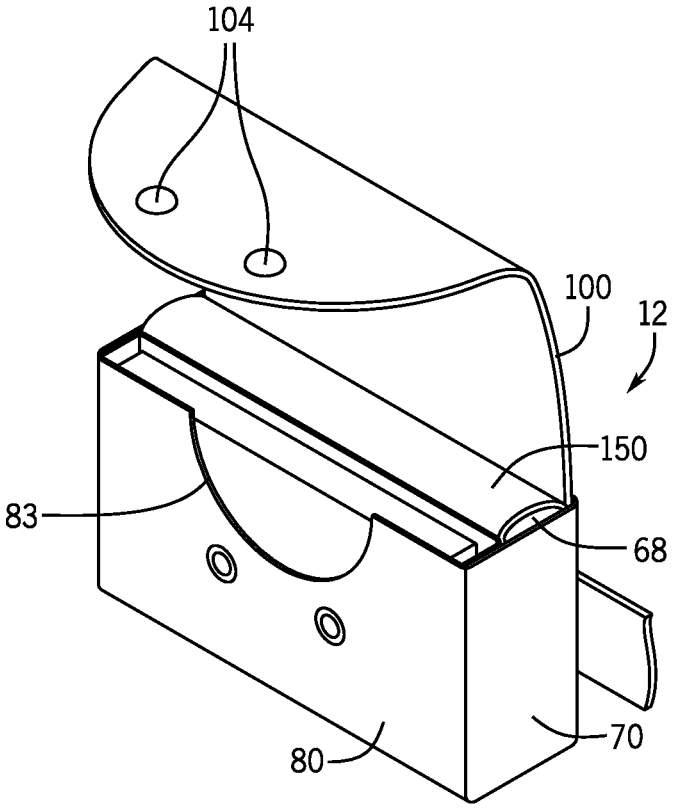
FIG. 16 is a perspective view of another aspect of the dual compartment gun holster having the secondary cover with the flap in an open position.
Figure 17:
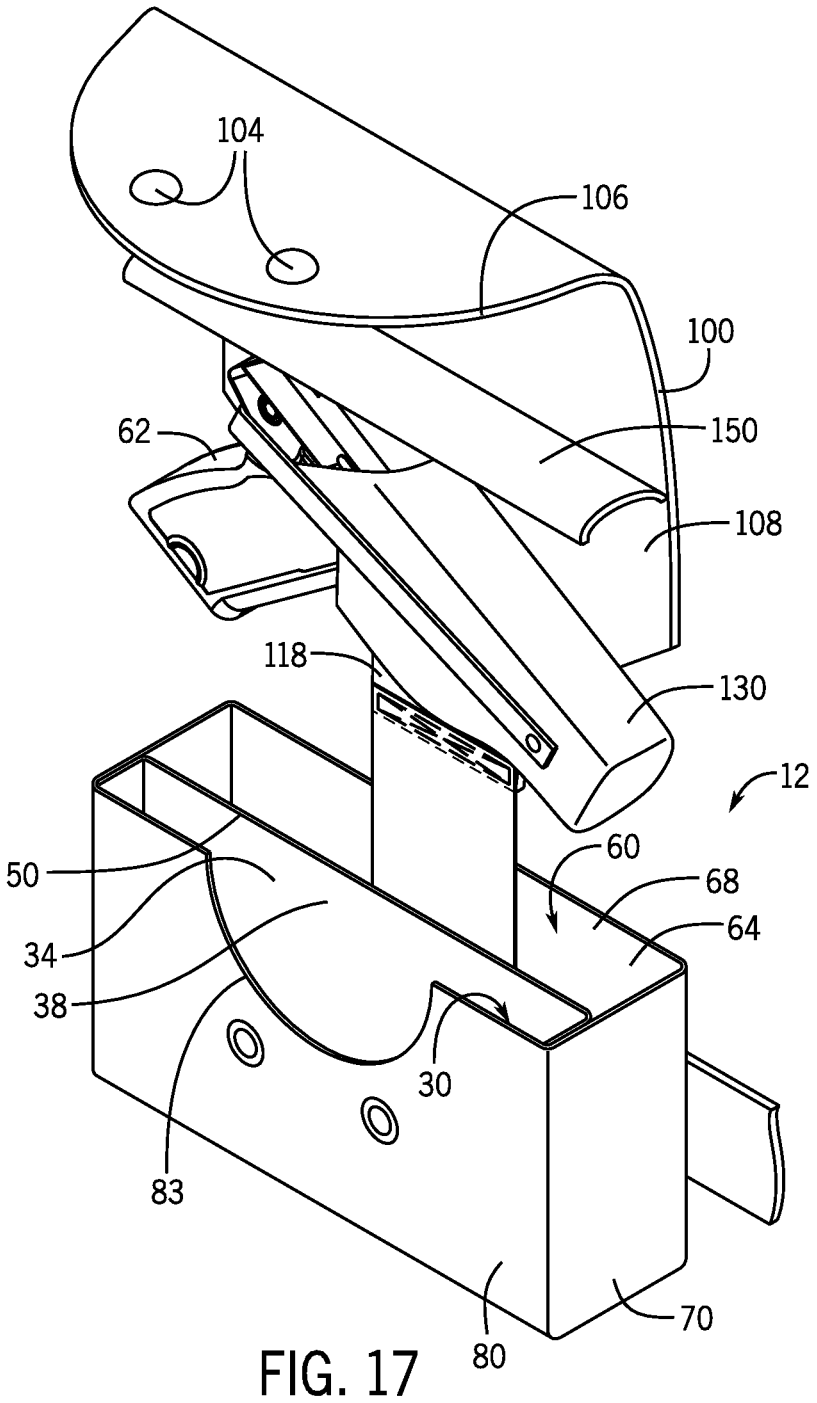
FIG. 17 is a perspective view of another aspect of the dual compartment gun holster having the secondary cover with the flap in an open position.

In another aspect, a dual compartment gun holster 12 will now be described with reference to FIGS. 16-17. The holster 12 generally includes the same or similar construction of the holster 10 including the first compartment 30 for holding the electronic device 32 and the second compartment 60 for holding the gun 62. In this aspect, the gun holster 12 includes a secondary cover 150 that further conceals the gun 62 when the flap 100 is opened to access the electronic device 32 in the first compartment 30. The secondary cover 150 extends from the flap 100. The secondary cover 150 is sized and shaped to cover the second opening 68 of the second compartment 60. The secondary cover 150 extends from the flap 100 above the holding member 130. The secondary cover 150 extends from the inner surface 108 of the flap 100 in the direction of the central wall 50. The secondary cover 150 helps to further conceal the gun 62. Thus, the user may open the flap 100 to retrieve the electronic device 32 while still concealing the gun 62 with the secondary cover 150. When the user opens the flap 100 to access and remove the personal electronic device 32 from the first compartment 30, the secondary cover 150 still conceals the gun 62 in the second compartment 60. Thus, the holster 12 appears to just be an ordinary cell phone case.

As such, it should be understood that the disclosure is not limited to the particular aspects described herein, but that various changes and modifications may be made without departing from the spirit and scope of this novel concept as defined by the following claims. Further, many other advantages of applicant's disclosure will be apparent to those skilled in the art from the above descriptions and the claims below.

What is claimed is:

1. A dual compartment gun holster, comprising:

a front wall and a rear wall connect or join with end walls;

a central wall positioned between the front wall and the rear wall to form a first compartment and a second compartment;

the first compartment defining a first interior and a first opening;

the second compartment defining a second interior and a second opening;

a flap configured to cover the first opening and the second opening, and the flap having an extending piece that is affixed to the second interior;

the extending piece comprising a holding member to hold a gun; and, the flap is integral with or attached to the extending piece;

the extending piece extends from and retracts into the second interior of the second compartment.

2. The dual compartment gun holster according to claim 1, wherein the first compartment is configured to hold a personal electronic device, and the second compartment is configured to hold the gun.

3. The dual compartment gun holster according to claim 1, wherein the extending piece is attached to an interior surface or a bottom wall of the second compartment, and the extending piece is in between the flap and the second compartment.

4. The dual compartment gun holster according to claim 1, wherein the extending piece is formed from or includes a resiliently flexible material.

5. The dual compartment gun holster according to claim 1, wherein a secondary cover extends from the flap, wherein the secondary cover is sized and shaped to cover the second opening of the second compartment.

6. The dual compartment gun holster according to claim 1, wherein end walls of the holster include a pleated construction.

7. The dual compartment gun holster according to claim 1, wherein the second compartment is configured to be positioned between a user's body and the first compartment.

8. The dual compartment gun holster according to claim 1, wherein the extending piece has a length to allow the gun to be fully removed from the second compartment.

9. The dual compartment gun holster according to claim 1, wherein the first compartment and the second compartment have generally rectangular shapes.

10. The dual compartment gun holster according to claim 1, wherein the first compartment is immediately adjacent to the second compartment.

11. The dual compartment gun holster according to claim 1, wherein a long axis of the first compartment is generally parallel to a long axis of the second compartment.

12. The dual compartment gun holster according to claim 1, wherein the gun and the extending member are moved generally upward through the second opening.

13. The dual compartment gun holster according to claim 1, wherein the extending piece is configured to extend from the second compartment to an extended position and retract into the second compartment to a retracted position, and wherein, in the extended position, the holding member is fully removed from the second compartment.

14. The dual compartment gun holster according to claim 13, wherein, in the extended position, the gun held by the holding member is fully removed from the second compartment.

15. The dual compartment gun holster according to claim 1, wherein the end walls are formed from a first material, the front wall and the rear wall are formed from a second material, and the first material has greater flexibility or stretch than the second material.

16. The dual compartment gun holster according to claim 1, wherein the extending piece retracts from the second interior of the second compartment to a retracted position wherein the holding member is inside of the second interior.

17. A dual compartment gun holster, comprising:

a front wall and a rear wall connect or join with end walls;

a central wall positioned between the front wall and the rear wall to form a first compartment and a second compartment;

the first compartment defining a first interior and a first opening;

the second compartment defining a second interior and a second opening;

a flap configured to cover the first opening and the second opening, and the flap having an extending piece that is affixed to the second interior;

the extending piece comprising a holding member to hold a gun;

a secondary cover extends from the flap, wherein the secondary cover is sized and shaped to cover the second opening of the second compartment; and the flap is configured to open to access the first compartment, while the secondary cover covers the second compartment.

18. A dual compartment gun holster, comprising:

a first compartment defining a first interior and a first opening;

a second compartment defining a second interior and a second opening;

a flap configured to cover the first opening and the second opening, and the flap having an extending piece that is affixed to the second interior;

the extending piece comprising a holding member configured to hold a gun;

wherein the first compartment is configured to hold a personal electronic device, and the second compartment is configured to hold the gun; and, wherein the extending piece is attached to the second compartment and the extending piece is configured to extend from the second compartment and retract into the second compartment.

19. A dual compartment gun holster, comprising:

a front wall and a rear wall connect or join with end walls;

a central wall positioned between the front wall and the rear wall to form a first compartment and a second compartment;

the first compartment defining a first interior and a first opening;

the second compartment defining a second interior and a second opening;

a flap configured to cover the first opening and the second opening and extend over a portion of the front wall, and the flap having an extending piece that is affixed to the second interior;

the extending piece comprising a holding member configured to hold a gun;

wherein the first compartment is configured to hold a personal electronic device, and the second compartment is configured to hold the gun; and, wherein the extending piece is configured to extend from the second compartment to an extended position and retract into the second compartment to a retracted position, and wherein, in the extended position, the holding member is fully removed from the second compartment.

20. The dual compartment gun holster according to claim 19, wherein the extending piece is configured to moved generally upward through the second opening.

* * * * *